United States Patent [19]

Richter et al.

[11] Patent Number: 4,810,835

[45] Date of Patent: Mar. 7, 1989

[54] FLAME-RESISTANT ELECTRIC LINE

[75] Inventors: Siegfried Richter, Eckental; Helmar Hetz, Sulzbach-Rosenberg, both of Fed. Rep. of Germany

[73] Assignee: kabelmetal electro Gesellschaft mit beschränkter Haftung, Hanover, Fed. Rep. of Germany

[21] Appl. No.: 98,266

[22] Filed: Sep. 18, 1987

[30] Foreign Application Priority Data

Sep. 18, 1986 [DE] Fed. Rep. of Germany ..... 3631699

[51] Int. Cl.[4] ..... H01B 7/34

[52] U.S. Cl. ..... 174/107; 174/105 R; 174/105 SC; 174/106 SC; 174/121 A

[58] Field of Search ..... 174/105 R, 105 SC, 121 R, 174/107, 121 A, 121 SR, 106 R, 106 SC

[56] References Cited

U.S. PATENT DOCUMENTS

| | | | |
|---|---|---|---|
| 3,576,940 | 5/1971 | Stone et al. | 174/121 A X |
| 3,617,377 | 11/1971 | Isshiki et al. | 174/105 R |
| 3,643,007 | 2/1972 | Roberts et al. | 174/107 X |
| 3,790,697 | 2/1974 | Buckingham | 174/107 X |
| 4,150,249 | 4/1979 | Pedersen | 174/121 A X |
| 4,280,225 | 7/1981 | Willis | 174/121 A X |
| 4,472,597 | 9/1984 | Uematsu | 174/107 X |
| 4,520,230 | 5/1985 | Uesugi et al. | 174/107 |
| 4,549,041 | 10/1985 | Shingo et al. | 174/121 A X |
| 4,659,871 | 4/1987 | Smith et al. | 174/121 A X |

FOREIGN PATENT DOCUMENTS

| | | | |
|---|---|---|---|
| 2800688 | 7/1978 | Fed. Rep. of Germany . | |
| 3044871 | 7/1982 | Fed. Rep. of Germany . | |
| 78087 | 7/1978 | Japan | 174/121 A |

*Primary Examiner*—Morris H. Nimmo
*Attorney, Agent, or Firm*—Martin A. Farber

[57] ABSTRACT

The invention relates to a flame-resistant electric line having a conductor (1) which is surrounded by an insulation (2) over which there is a shielding (3). A ribbon (4) consisting of a glass cloth provided with a metal layer on one side is wound in overlapping manner over the shielding (3). The metal layer is on the outside in the line. The width (B) of the overlap is between 7% and 35% of the width of the ribbon (4). A sheathing (5) of insulating material is arranged over the ribbon (4).

9 Claims, 1 Drawing Sheet

FLAME-RESISTANT ELECTRIC LINE

FIELD AND BACKGROUND OF THE INVENTION

The present invention refers to a flame-resistant electric line consisting of at least one electric conductor, an insulation surrounding same, and a ribbon of glass cloth wrapped with overlapping edges around the insulated conductor and provided with a layer of metal on one side.

West German Pat. No. 30 44 871 provides this.

"Lines" within the meaning of the invention are intended to be lines by which communication engineering signals can be transmitted with low loss and free of interference. Thus in principle high-frequency (HF) lines and low-frequency (LF) lines are concerned. HF lines are used, for instance, in radio direction finding and antenna systems as well as in ultrashort wave broadcast and television receiving systems. LF lines are required, for instance, for electroacoustics and audio frequency measurements. With only one conductor they are used, for instance, as connecting wire for crystal microphones, magnetic sound heads and dictation machines.

For the development of the lines and for the materials used for this, fundamentally, only their electrical properties for the obtaining of the best transmission properties are taken into consideration. For many uses, such as, for instance, upon installation in buildings or switchboards, assurance must also be had that in case of fire and lines themselves will not burn and that they will continue to operate even at very high temperatures for at least a certain period of time. In this sense, by the expression "flame resistant" there are to be understood those special properties of an electric line in case of a fire which include freedom from smoke, non-burnability and freedom from halogens.

West German No. 05 28 00 688 describes an electric cable having conductors whose insulation consists of a mica ribbon with a layer of rubber lying over it. The insulated conductors (wires) of this cable are wrapped with an aluminum-plastic laminate. Around the cable core consisting of the wires, there is wrapped a polyester ribbon, over which a layer of a thermoplastic elastomer filled with aluminum hydroxide is applied. Above this there is wound a fiberglass mat over which a braided metal armoring is present. As outer protective sheathing, a layer of chlorosulfonated polyethylene is applied. The expense for the manufacture of such a cable is considerable. This is true both of the conductors, the insulation of which includes a mica ribbon, and of the entire cable, the sheathing of which surrounding the cable core consists of five different layers which cannot be applied in a single operation. Such a cable is therefore scarcely feasible economically.

The line of the aforementioned German Pat. No. 30 44 871 is of substantially simpler construction. In it only a single polyester ribbon coated with aluminum and an outer protective sheathing of plastic applied over the core, which is formed of a plurality of insulated conductors. A highly filled polyvinyl chloride mixture is used for the insulating of the conductors. The purpose hereof is to see to it that the insulation still remains stable even at very high temperatures of more than 1000° C. so that short-circuits are avoided. Because of the special insulating material this known conductor cannot be used for cases in which there are high demands on the transmission properties. Furthermore should fire for any reason still reach the polyvinyl chloride, then the polyvinyl chloride itself begins to burn, liberating highly toxic and dangerous gaseous chlorine.

It is an object of the invention to provide a flame-resistant line which, while still of simple construction, satisfies high demands as to its transmission properties and is unburnable even at temperatures of more than 1000° C.

SUMMARY OF THE INVENTION

Accordingly, the invention provides that:

- the insulation (2) of the conductor (1) consists of a halogen-free polymeric plastic;
- a metal shielding (3) is arranged over the insulation (2);
- the ribbon (4) with outer layer of metal is wound around the shielding (3);
- the width (B) of the overlap is between substantially 7% and 35% of the width of the ribbon (4); and
- a sheathing (5) of insulating material is arranged over the ribbon (4).

For the insulating of the conductor, a halagen-free polymeric plastic such as, for instance, polyethylene is used, by which the favorable transmission properties of the line are guaranteed. Because of its good transmission properties, this material is tolerated although in itself it is burnable. However, it is so effectively protected by the ribbon of metal-coated glass cloth wrapped with a given, predetermined overlap that it cannot burn. The ribbon is wrapped on the insulation or shielding in such a manner that the layer of metal is on the outside. It therefore acts like a closed metal tube with respect to a flame. On the other hand, however, the overlap is so small that this "tube" has sufficient gaps in order for the gases produced within it by the high heat to escape. Bursting of the covering surrounding the ribbon is thus avoided. The shielding necessary for the purpose of use of the line is also surrounded by the ribbon and therefore also protected by it. The sheathing which is applied as an outer layer serves as mechanical protection for the entire line and, in particular, for the ribbon.

A feature of the invention is that the width (B) of the overlap is equal to 20% of the width of the ribbon (4).

Another feature is that a layer (6) of semiconductive material is present between the insulation (2) and the shielding (3).

Still further according to a feature of the invention the shielding (3) is developed as a braid or stranding.

Also, the screening (3) consists of a metal ribbon wound or longitudinally folded thereon.

Moreover, the insulation (2) can consist of polyethlene.

Still further, the sheathing (5) can consist of a copolymer of polyethylene which has been made flame-repellent.

The invention furthermore provides for the use of such a line as a high-frequency line.

BRIEF DESCRIPTION OF THE DRAWING

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENTS

Figure 1:
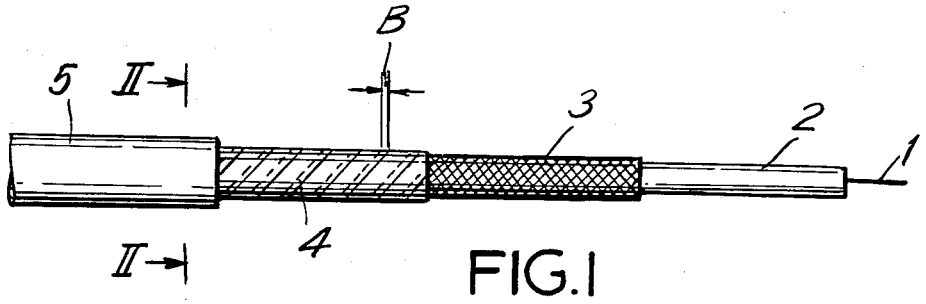
FIG. 1 is a side view of a line according to the invention, with layers removed step-wise.
Figure 2:
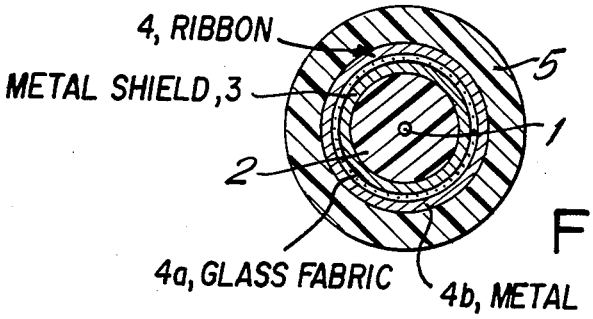
FIG. 2 is a section along the line II—II of FIG. 1, on a larger scale.
Figure 3:
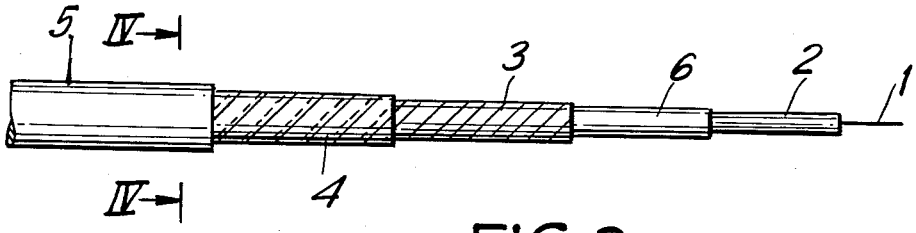
FIG. 3 is a side view of a line which differs from FIG. 1.

FIG. 1 shows an HF line having a conductor 1, an insulation 2 and a shielding 3. The conductor 1 can be developed as stranded conductor having a plurality of combined individual wires or else as a solid conductor. It preferably consists of copper. The shielding 3 which lies over the insulation 2—also referred to as "outer conductor" in HF lines—can consist of braided or stranded individual wires (FIG. 1). However, as shown in FIG. 3, it can also consist of a metal ribbon which is wound or longitudinally folded around the insulation 2. The shielding 3 also preferably consists of copper.

A halogen-free polymeric plastic is used as material for the insulation 2. In the preferred embodiment, the insulation 2 consists of polyethylene. This material has excellent electrical properties. It is therefore excellently suited for HF lines. In principle, the insulation 2 can also consist of some other polymeric plastic, such as, for instance, polypropylene. All of these materials burn readily. For many cases of use the HF line therefore must be so developed that the insulation 2 cannot burn.

For this purpose, a ribbon 4 is wound in overlapping fashion over the shielding 3, it consisting of a glass cloth which is provided with a layer of metal on one side. The layer of metal covers the ribbon 4 over its entire length and width. It may consist, for instance, of aluminum or copper. The layer of metal lies on the outside in the line. Over the ribbon 4, a sheathing 5 of insulating material is present for the protection of the ribbon 4. This sheathing may consist, for instance, of a polyethylene copolymer which has been made flame repellent.

Figure 4:
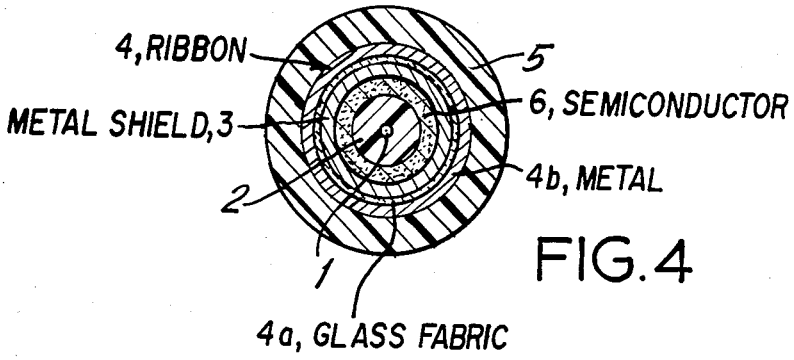
FIG. 4 is a section along the line IV—IV of FIG. 3, on a larger scale.

In the embodiment shown in FIGS. 3 and 4, a semiconductive layer 6 can, in addition, be arranged over the insulation 2, the shielding 4 lying over it. The layer 6 serves to avoid howl.

The line of the invention having the construction shown in the embodiments is flame-resistant. It does not burn even under high heat and an open flame. In the region of an open flame only the sheathing 5 melts, so that the ribbon 4 or the layer of metal thereof is exposed. The ribbon 4 constitutes a barrier for open flames. It has a flame-retarding effect so that the surrounded line and in particular the insulation 2, which in itself is burnable, are effectively protected. This applies even for temperatures of more than 1000° C.

By the overlapped winding of the ribbon 4, the ribbon represents, in effect, a closed metallic tube which is effective against flame. Sufficiently large gaps are present, however, in this tube through for gases produced within it to escape. This is necessary at very high temperatures, at which the material of the insulation 2 decomposes.

The overlap of the individual turns of the ribbon 4 therefore must not be too great. However, it must also not be too small in order that the closed layer formed by the ribbon 4 does not gap open upon the bending of the line. The width "B" of the overlap should therefore be between 7% and 35% of the width of the ribbon 4. In the preferred embodiment the width of the overlap is 20%.

We claim:

1. A flame-resistant high-frequency line comprising an electric inner conductor, an insulation made of a halogen-free polymeric plastic surrounding said inner conductor, a metal shielding serving as an outer conductor disposed over the insulation and an outer jacket of insulating material, and a ribbon of glass fabric, the ribbon including a layer of metal on one side of the glass fabric, the ribbon being wrapped with overlapping edges around said metal shielding, the layer of metal lying on the outside of the glass fabric; and wherein said ribbon is wrapped with an overlap that is between substantially 7% and 35% of the width of the ribbon; and the outer jacket comprises a flame proof copolymer of polyethylene disposed directly over said ribbon.

2. A flame-resistant electric line according to claim 1, wherein the width of the overlap is equal to 20% of the width of the ribbon.

3. A flame-resistant electric line according to claim 1, further comprising a layer of semiconductive material located between said insulation and said shielding.

4. A flame-resistant electric line according to claim 1, wherein said shielding is formed as a braid.

5. A flame-resistant electric line according to claim 1, wherein said shielding is formed as a stranding.

6. A flame-resistant electric line according to claim 1, wherein the shielding comprises a metal ribbon wound thereon.

7. A flame-resistant electric line according to claim 1, wherein the shielding comprises a metal ribbon longitudinally folded thereon.

8. A flame-resistant electric line according to claim 1, wherein said insulation is made of polyethylene.

9. A flame-resistant electric line according to claim 2, wherein a layer of semiconductive material is located between said insulation and said shielding.

* * * * *